US005820036A

United States Patent [19]

Saito

[11] Patent Number: 5,820,036

[45] Date of Patent: Oct. 13, 1998

[54] ELECTROSTATIC COATING APPARATUS

[75] Inventor: Eiji Saito, Yokohama, Japan

[73] Assignee: Ransburg Industrial Finishing KK, Tokyo, Japan

[21] Appl. No.: 888,844

[22] Filed: Jul. 7, 1997

[30] Foreign Application Priority Data

Jul. 8, 1996 [JP] Japan ..... 8-177661

[51] Int. Cl.[6] ..... B05B 5/04

[52] U.S. Cl. ..... 239/703; 239/700; 239/224

[58] Field of Search ..... 239/690, 700, 239/703, 705, 708, 224

[56] References Cited

U.S. PATENT DOCUMENTS

| | | | |
|---|---|---|---|
| 3,504,851 | 4/1970 | Demeter | 239/703 |
| 4,572,437 | 2/1986 | Huber et al. | 239/700 X |
| 4,601,921 | 7/1986 | Lee | 239/703 X |

FOREIGN PATENT DOCUMENTS

| | | |
|---|---|---|
| 48-43426 | 6/1973 | Japan . |
| 51-126237 | 4/1976 | Japan . |
| 52-74637 | 6/1977 | Japan . |
| 52-74638 | 6/1977 | Japan . |
| 52-74639 | 6/1977 | Japan . |
| 52-80337 | 6/1977 | Japan . |
| 52-95756 | 11/1977 | Japan . |
| 55-147165 | 11/1980 | Japan . |
| 1-41496 | 7/1989 | Japan . |
| 4-71656 | 3/1992 | Japan . |

*Primary Examiner*—Lesley D. Morris
*Attorney, Agent, or Firm*—MacMillan, Sobanski & Todd, LLC

[57] ABSTRACT

An electrostatic coating apparatus, comprising:

a) an atomizing head assembly including:
   1) an atomizing head; and
   2) a coupling disposed around a forward half portion of the atomizing head, the forward half portion of the atomizing head and the coupling forming a first path for shaping air therebetween;

b) a driving mechanism for rotating the atomizing head assembly, the driving mechanism having an output shaft connected to the atomizing head, the output shaft being tubular to supply coating materials to the center of the atomizing head therethrough; and c) a casing disposed around a rear half portion of the atomizing head and the driving mechanism, the casing having a second path for shaping air which is communicated with the first path.

3 Claims, 5 Drawing Sheets

ELECTROSTATIC COATING APPARATUS

BACKGROUND OF THE INVENTION

The present invention generally relates to an electrostatic coating apparatus, and, more particularly, to an electrostatic coating apparatus for spraying fluids or coating materials atomized by an atomizing head rotated at a high speed toward a workpiece.

DESCRIPTION OF THE PRIOR ART

An electrostatic coating apparatus which atomizes coating materials by an atomizing head rotated at a high speed has been known as described in Japanese Patent Public Disclosure No. Sho 55-12305, Japanese Patent Public Disclosure No. Sho 57-17588, and Japanese Patent Laid-open Disclosure No. Hei 4-71656.

These kinds of electrostatic coating apparatuses are categorized into two types, i.e., a side-feed type and a central-feed type, depending on the way the coating materials are supplied to the atomizing head. The side-feed type supplies the coating materials through a fixed pipe provided rearward of the atomizing head (see Japanese Patent Public Disclosure No. Sho 55-42857). The center-feed type has a rotary driving shaft consisting of a tubular shaft connected to the atomizing head and the coating materials are supplied through an inner passage of the rotary driving shaft (see Japanese Utility Model Public Disclosure No. Hei 1-41496).

The center-feed type coating apparatus has an advantage compared to the side-feed type in respect that the coating material can be uniformly sprayed from the atomizing head because the coating material is fed into the center of the atomizing head. Explaining in more detail regarding the coating apparatus described in Japanese Utility Model Public Disclosure No. Hei 1-41496 by way of example of the conventional center-feed type electrostatic coating apparatuses, the coating apparatus is constituted as follows:

(1) A tubular rotary shaft connected to the atomizing head is joined to an air motor, and a ball bearing, a roller bearing, or an air bearing is utilized as a bearing for the tubular rotary shaft;

(2) A high voltage impress path to the atomizing head connects a body of the coating apparatus with a high voltage cable and the high voltage is supplied from the body of the coating apparatus to the atomizing head via the rotary driving shaft;

(3) An insulating cover member is provided around the body of the coating apparatus and the atomizing head to assure its safety; and (4) The coating material discharged from the atomizing head is atomized and a spray pattern is formed by utilizing a space between the cover member and the atomizing head as an air path to discharge air therethrough along the periphery of the atomizing head.

In accordance with the above-mentioned coating apparatus, by centrally feeding the coating material, spray thereof can be uniform. Moreover, when, for example, an air bearing is utilized, the atomizing head can be rotated at a high speed to atomize the coating material. Therefore, it enables to provide an electrostatic coating apparatus which can uniformly spray the atomized coating material.

However, in the case that the head is rotated at a high speed, an effect by pressurized air flowing through the air path between the cover member and the atomizing is not negligible. That is, since the atomizing head is exposed to the air path formed between itself and the cover member, the friction is generated on an outer surface of the head by the pressurized air passing through the air path and the friction acts to inhibit the rotation of the head.

SUMMARY OF THE INVENTION

It is, therefore, an object of the present invention to provide a coating apparatus having an atomizing head assembly including an atomizing head to which a coating material is supplied through a passage within a tubular rotary driving shaft connected to the head and the air discharged from the circumferencial edge of the head passes through the atomizing head assembly thereby preventing a detrimental effect on the outer peripheral surface of the head.

The above and other objects of the present invention can be accomplished by an electrostatic coating apparatus, comprising:

an atomizing head assembly including:

1) an atomizing head; and 2) a coupling disposed around a forward half portion of said atomizing head, said forward half portion of said atomizing head and said coupling forming a first path for shaping air therebetween;

b) a driving mechanism for rotating said atomizing head assembly, said driving mechanism having an output shaft connected to said atomizing head, said output shaft being tubular to supply coating materials to the center of said atomizing head therethrough; and c) a casing disposed around a rear half portion of said atomizing head and said driving mechanism, said casing having a second path for shaping air formed therein, said second path being communicated with said first path.

By employing such construction, since the shaping air is supplied through the second path formed in the casing, the shaping air is prevented from directly blowing against the peripheral surface of the rear half portion of the atomizing head and does not give a detrimental effect on the rotational performance of the atomizing head.

In a preferred aspect of the present invention, said coupling having a cylindrical skirt portion extending rearwardly, said skirt portion and an outer peripheral surface of said rear half portion of said atomizing head forming an annular recess opened rearwardly therebetween, at least a forward end portion of said casing surrounding said rear half portion of said atomizing head being cylindrical, said forward end portion being inserted into said annular recess so as to form a small clearance between an outer peripheral surface, an inner peripheral surface and a forward end surface of said cylindrical forward end portion, and the corresponding inner surfaces of said annular recess. In accordance with the present invention, a part of the air supplied to the first and second paths flows into the clearance and functions as an air bearing between the annular recess of the atomizing head assembly and the forward end portion of the casing. It enables to suppress vibration of the atomizing head assembly in axial and radial directions. Therefore, the rotational performance of the atomizing head assembly can be improved.

In a further preferred aspect of the present invention, said second path of said casing having a bent path portion at a transitional region between a first casing portion surrounding said driving mechanism and a second casing portion surrounding said rear half portion of said atomizing head, said bent path portion having an annular chamber extending in a circumferential direction, said second path forward of said annular chamber having a plurality of through holes equally spaced in a circumferential direction.

The above and other objects and features of the present invention will become apparent from the following description made with reference to the accompanying drawings.

DESCRIPTION OF THE PREFERRED EMBODIMENTS

Now, a preferred embodiment of the present invention shall be explained in detail with reference to the attached drawings.

Figure 1:
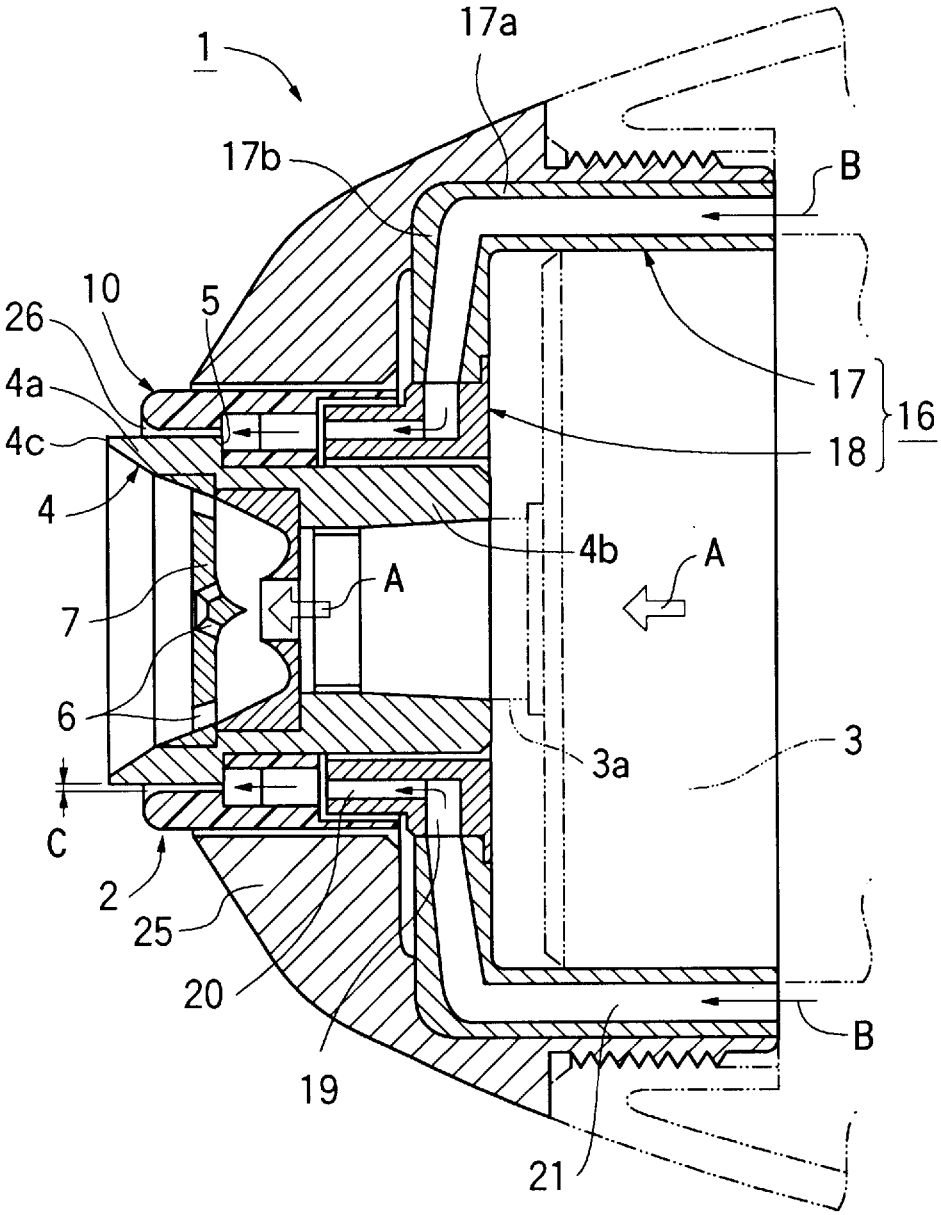
FIG. 1 is a cross-sectional view showing a forward portion of an electrostatic coating apparatus in accordance with a first embodiment of the present invention.

FIG. 1 is a cross-sectional view of a forward end portion of an electrostatic coating apparatus 1 in accordance with a first embodiment of the present invention. The coating apparatus 1 comprises a driving mechanism 3 for rotating an atomizing head assembly 2. The driving mechanism 3 comprises elements such as an air motor and an air bearing as has been conventionally known. A driving shaft 3*a* extending from the driving mechanism 3 consists of a tubular shaft. A coating material is supplied to the atomizing head assembly 2 through an inner space of the tubular driving shaft 3*a*. In FIG. 1, the arrow A indicates a flow of the coating material supplied to the atomizing head assembly 2.

The atomizing head assembly 2 has an atomizing head 4 in a substantially cylindrical form and made of metal. An outer peripheral surface of the head 4 consists of a stepped surface having a step 5. An end portion 4*a* forward of the step 5 has a larger diameter compared to a portion 4*b* rearward of the step 5. An inner peripheral surface of the head 4 is of a conical shape having an opening with an increased cross-sectional dimension toward a forward end thereof. At a middle portion thereof, a bulkhead 7 with passages 6 each having a small diameter is provided. Since such an atomizing head 2 has been conventionally known, the detail explanation thereof shall be omitted.

However, explaining briefly, the coating material supplied to the head 4 through the inner passage of the driving shaft 3*a* in the direction of the arrow A flows toward the forward end while spreading in the form of a film along the inner peripheral surface of the head 4 rotated at a high speed. It is, then, discharged and atomized from a forward edge 4*c*.

Figure 2:
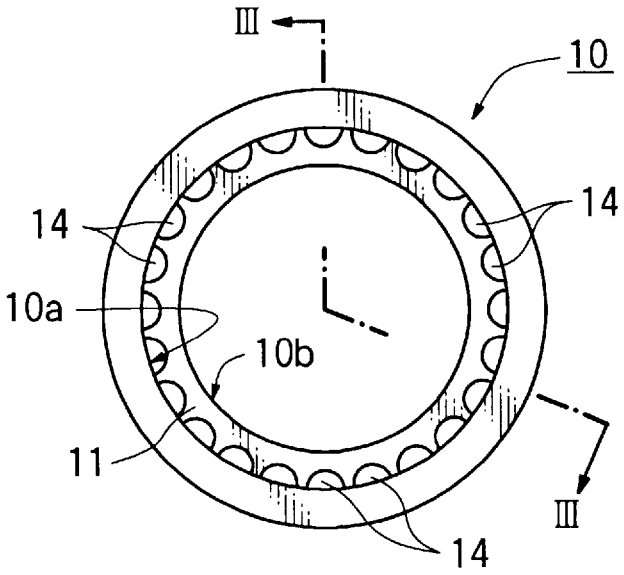
FIG. 2 is a plan view of a coupling to be attached around an atomizing head.
Figure 3:
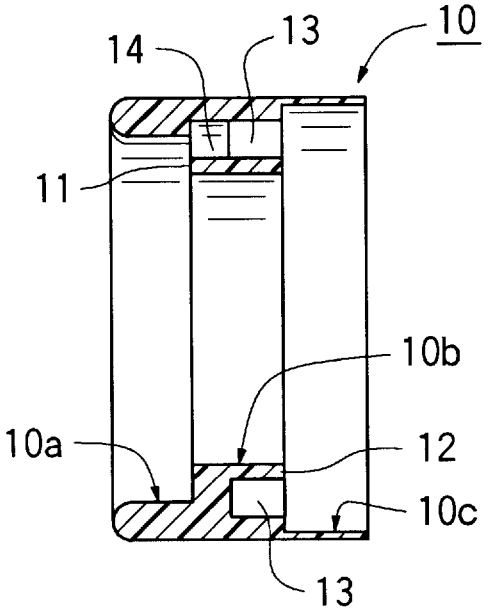
FIG. 3 is a cross-sectional view taken along line III—III of FIG. 2.

The atomizing head assembly 2 has a coupling 10 which surrounds and attachs to the head 4. The coupling 10 is made of synthetic resin and has a cylindrical outer peripheral surface as illustrated in FIGS. 2 and 3. An inner peripheral surface of the coupling 10 consists of three stepped portions 10*a*, 10*b*, 10*c* formed by a first step 11 and a second step 12. An inner diameter of the forward portion 10*a* of the first step 11 is dimensioned to be slightly larger than an outer diameter of 25 the forward end portion 4*a* of the head 4 to form a clearance C therebetween (see FIG. 1). An inner diameter of the middle portion 10*b* intervened between the first step 11 and the second step 12 is dimentioned to be sealingly fitted onto the rearward portion 4*b* of the head 4 whereby the head 4 and the coupling 10 are firmly coupled. The portion 10*c* rearward of the second step 12 of the coupling 10 is of relatively thin wall which defines a skirt portion extending rearwardly and straight from the middle portion 10*b*.

As will be best appreciated from FIGS. 2 and 3, the middle portion 10*b* of the coupling 10 has an annular groove 13 in a rear half portion thereof. Further, a forward half portion of the middle portion 10*b* is provided with many through holes 14 communicated with the annular groove 13. The through holes 14 are equally spaced in a circumferential direction. As will be noted from FIG. 1, the coupling 10 having the afore-mentioned structure is assembled to the head 4 with the first step 11 in contact with the step 5 of the head 4 and rotates therewith.

A forward end portion of the driving mechanism 3 is surrounded by a casing 16. The casing 16 comprises an inner ring 17 disposed to surround the driving mechanism 3 and a guide ring 18 disposed to surround the rear half portion of the atomizing head assembly 2. The inner ring 17 has a cylindrical portion 17*a* extending along an outer periphery of the driving mechanism 3 and an end wall portion 17*b* extending radially inward from the forward end of the cilyndrical portion 17*a*. The guide ring 18 engages with an inner end of the end wall portion 17*b*.

Figure 4:
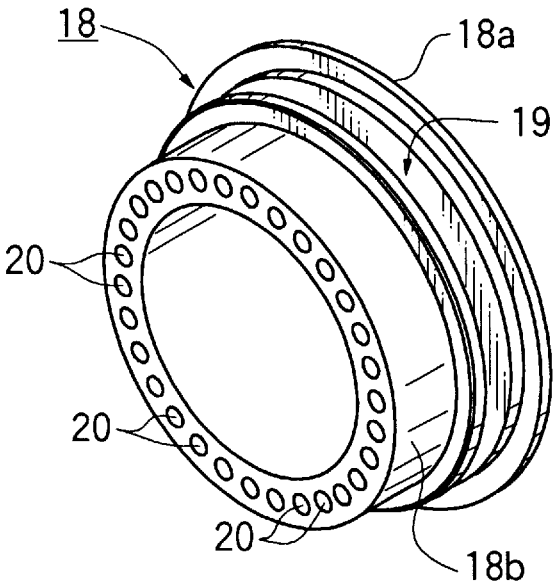
FIG. 4 is a perspective view of a guide ring disposed rearward of the atomizing head assembly.
Figure 5:
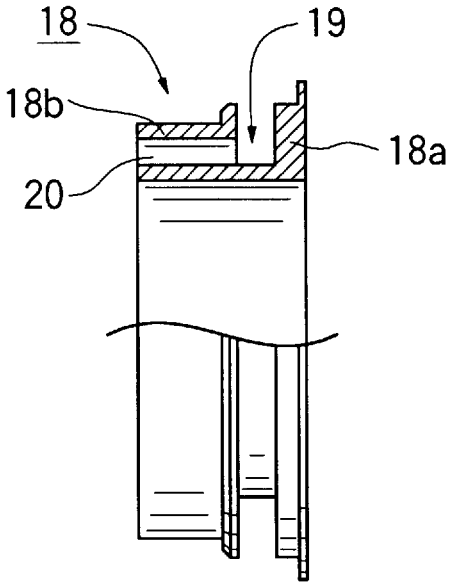
FIG. 5 is a side view showing the guide ring in FIG. 4 in part in section.

The guide ring 18 has a ring body 18*a* engaged with the inner ring 17 and a cylindrical guide portion 18*b* extending forwardly from the ring body 18*a*. As illustrated in FIGS. 4 and 5, the guide ring 18 has a groove 19 which is formed on an outer peripheral surface of the ring body 18*a* and which extends in a circumferential direction. Further, many air holes 20, which axially extend and communicate with the groove 19, are formed in the guide portion 18*b* of the guide ring 18. The air holes 20 are equally spaced in a circumferential direction.

The guide ring 18 is disposed in such a way to insert the guide portion 18*b* into the skirt portion 10*c* of the coupling 10. The length of the guide ring 18 is dimensioned to form a small space between a forward end surface of the guide portion 18*b* and the middle portion 10*b* of the coupling 10 when the guide ring 18 is assembled into the assembly 2. Further, the guide ring 18 has an inner diameter slightly larger than an outer diameter of the head 4 and the guide portion 18*b* has an outer diameter slightly smaller than an inner diameter of the skirt portion 10*c* of the coupling 10. Therefore, a small clearance is formed between an inner peripheral surface of the guide ring 18 and an outer peripheral surface of the head 4. Further, a small clearance is formed between and forward end surface of the guide ring 18 and the middle portion 10*b* of the coupling 10. Further more, a small clearance is formed between an outer surface of the guide portion 18*b* of the guide ring 18 and an inner surface of the skirt portion 10*c* of the coupling 10.

Figure 6:
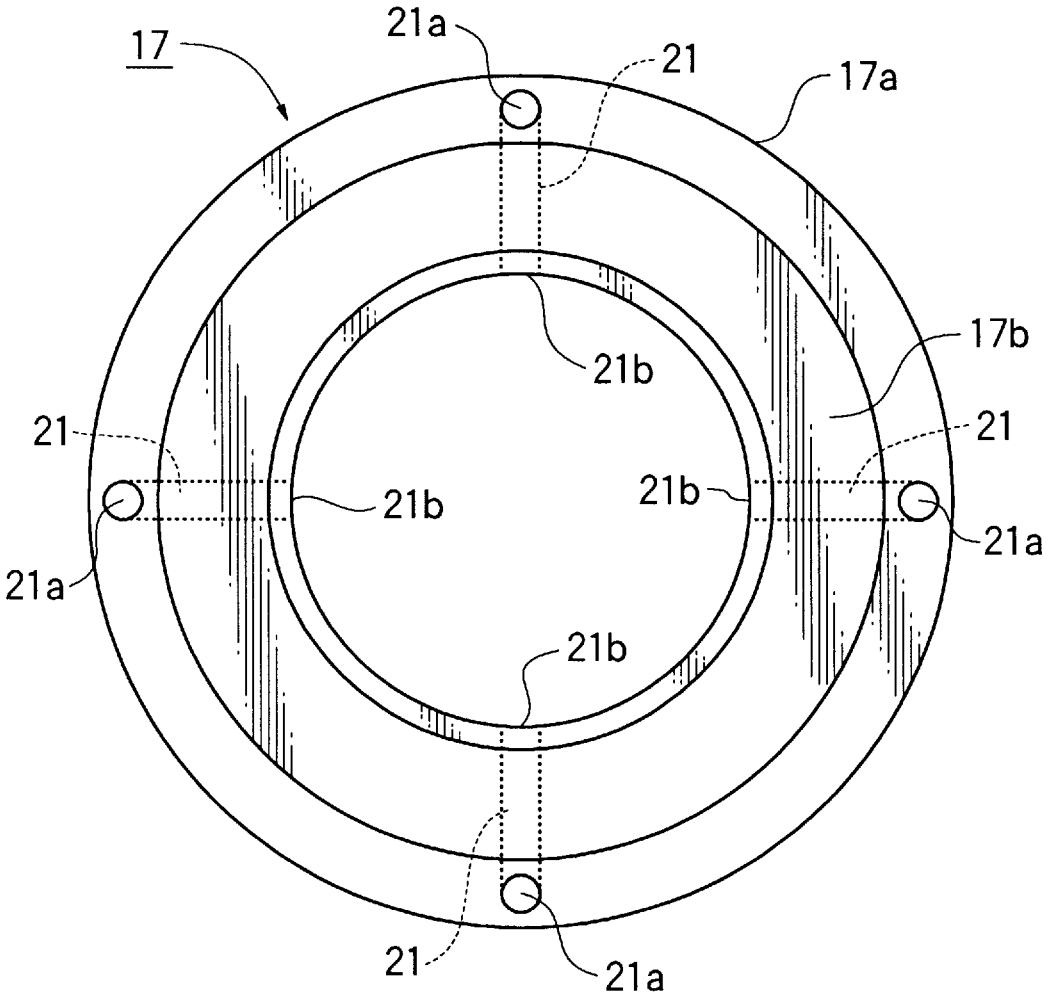
FIG. 6 is a rear view of an inner ring surrounding a driving mechanism of a coating apparatus as viewed from the rear side thereof.

As illustrated in FIGS. 1 and 6, the inner ring 17 has a plurality of through holes 21. The holes 21 extend axially along the cylindrical portion 17*a* from an inlet 21*a* on a rear end surface of the cylindrical portion 17*a* and further extend radially inward along the end wall portion 17*b* to an outlet

21*b* on an inner end surface of the end wall portion 17*b*. As well be noted from FIG. 6, four through holes 21 are provided and are equally spaced by 90° in a circumferential direction. However, the number of the through holes 21 may be determined as desired and for example, three through holes equally spaced by 120° can be provided.

The reference numeral 25 in FIG. 1 indicates a cap which surrounds around the atomizing head assembly 2. The cap 25 is sealingly fitted to an outer peripheral surface of the inner ring 17.

By the foregoing constitution, a clearance C which axially extends between the head 4 and the coupling 10 is formed in the atomizing head assembly 2 and defines a discharge path 26 for shaping air. An air path leading to the discharge path 26 comprises the holes 14 and the annular groove 13 of the coupling 10, the circumferential groove 19 and the air holes 20 of the guide ring 18, and the holes 21 of the inner ring 17. Pressurized air is supplied to the inlet 21*a* of the holes 21 from an air source (not shown). Therefore, as indicated by the arrow B in FIG. 1, the air supplied to the inlet 21*a* of the inner ring 17 is supplied to the discharge path 26 of the atomizing head assembly 2 through the inner ring 17 and the guide ring 18 and is discharged therefrom to shape an atomizing pattern of the coating material.

As evident from the foregoing, the shaping air discharged from the discharge path 26 does not make direct contact with the head 4 on the way to reach the discharge path 26. Therefore, unlike the prior art, it does not give any influence on rotation of the head assembly 2. Further, as will be appreciated from FIG. 1, the shaping air path leading to the discharge path 26 is bent 90° from the radially inward direction toward the axial direction. The bent portion of the air path is defined by the circumferential groove 19 of the guide ring 18. Therefore, after the air discharged from the holes 21 of the inner ring 17 is received into the groove 19 and spreads circumferentially along the groove 19, it flows into the axially extending air holes 20. Therefore, at this stage, the air entering the air discharge path 26 of the atomizing head assembly 2 can be uniformly distributed in a circumferential direction whereby the shaped air can be discharged from the path 26 evenly in a circumferential direction.

Further, an annular recess is formed by the skirt portion 10*c* of the coupling 10 in the rear half portion of the atomizing head assembly 2 for inserting the guide portion 18*b* of the guide ring 18 thereto.

Therefore, a part of the pressurized air discharged from the air hole 20 of the guide ring 18 flows into the clearances, each of which being formed between the inner surface of the guide ring 18 and the outer surface of the head 4, the forward end surface of the guide ring 18 and the middle portion of the coupling 10, and the outer surface of the guide portion 18*b* of the guide ring and the inner surface of the skirt portion 10*c* of the coupling 10. This air functions as an air bearing whereby physical contact between the members of the atomizing head assembly 2 is prevented and vibration in axial and radial directions is suppressed. It enables to enhance the performance of the head assembly 2 rotated at a high speed.

Figure 7:
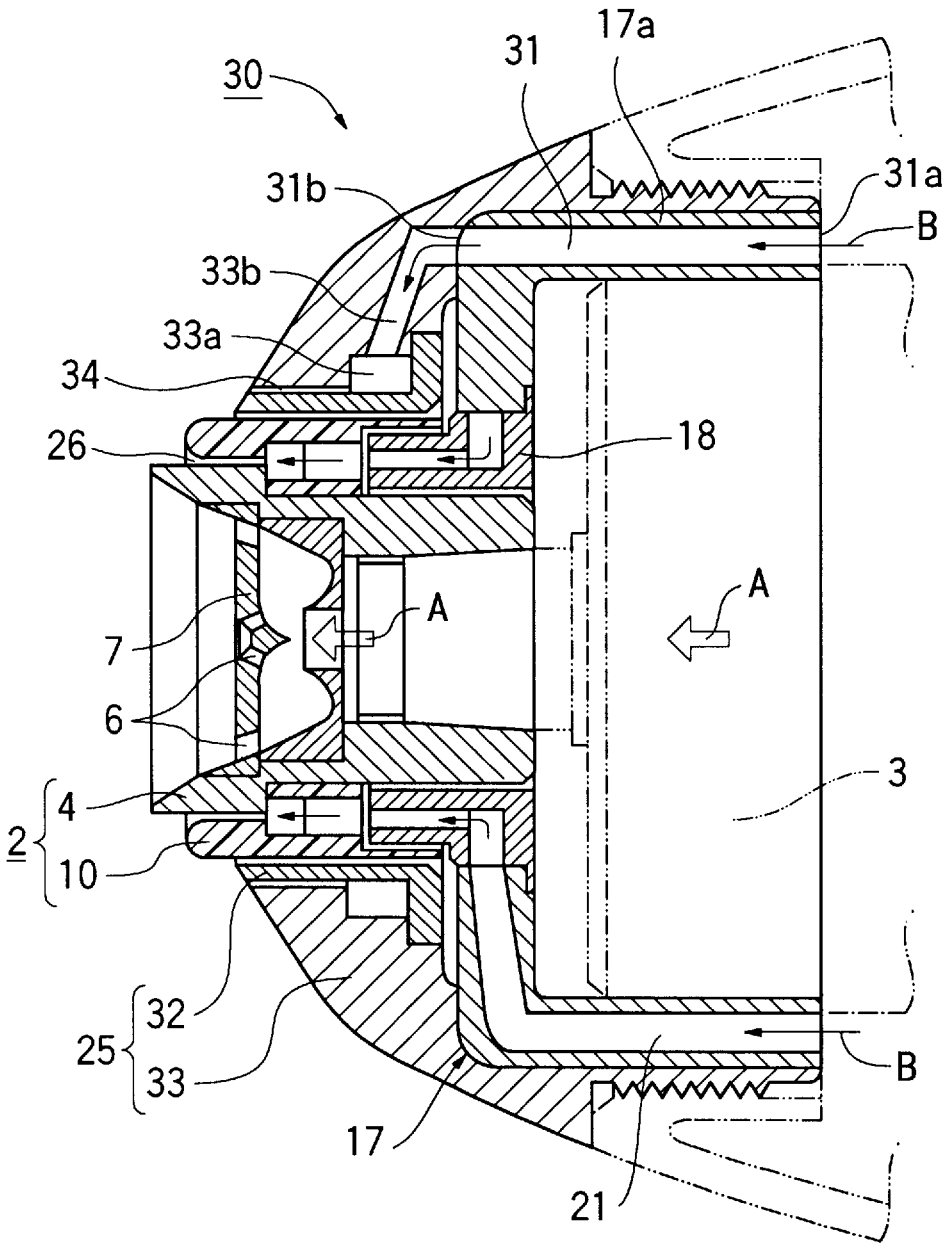
FIG. 7 is a partial cross-sectional view showing an forward portion of an electrostatic coating apparatus in accordance with a second embodiment of the present invention.

FIG. 7 is a cross-sectional view of the atomizing head assembly 2 of a coating apparatus 30 in accordance with a second enbodiment of the present invention. In the second embodiment, the same elements as in the foregoing first embodiment are denoted by the same numerals and the explanation thereof is ommited. The features of the second embodiment shall be explained hereinafter.

In the coating apparatus 30 in accordance with the second embodiment, second through holes 31 are formed in the cylindrical portion 17*a* of the inner ring 17. The through holes 31 extend axially from an inlet 31*a* on the rear end surface of the cylindrical portion 17*a* to an outlet 31*b* on the forward end surface of the cylindrical portion 17*a*.

Further, the cap 25 comprises a sleeve 32 which surrounds the atomizing head assembly 2 and a cap body 33 located radially outward of the sleeve 32. The cap body 33 is provided with a recess 33*a* formed on the inner surface thereof being opposed to the sleeve 32 and an air path 33*b* extending between the outlet 31*b* of the inner ring 17 and the recess 33*a*. The recess 33*a* of the cap body 33 is closed by the sleeve 32 and forms an annular space extending in a circumferencial direction of the cap 25.

In the cap body 33, a froward portion of the recess 33*a* has a slightly larger inner diameter than an outer diameter of the sleeve 32 whereby a circumferentially and axially extending second air dischage path 34 is formed between the cap 33 and the sleeve 32. Pressurized air is supplied to the second holes 31 of the inner ring 17 from an air source (not shown). The pressurized air flows from the outlet 31*b* of the holes 31 to the annular space formed by the recess 33*a* through the air path 33*b* of the cap 25. Then, the air flows from the annular space through the second discharge path 34 to be discharged forwardly. The air discharged forwardly from the second discharge path 34 functions as secondary shaping air.

The present invention has thus been shown and described with reference to specific embodiments. However, it should be noted that the present invention is in no way limited to the details of the described arrangements but changes and modifications may be made without departing from the scope of the appended claims.

I claim:

1. An electrostatic coating apparatus, comprising:

a) an atomizing head assembly including:

1) an atomizing head; and 2) a coupling disposed around a forward half portion of said atomizing head, said forward half portion of said atomizing head and said coupling forming a first path for shaping air therebetween;

b) a driving mechanism for rotating said atomizing head assembly, said driving mechanism having an output shaft connected to said atomizing head, said output shaft being tubular to supply coating materials to the center of said atomizing head therethrough; and c) a casing disposed around a rear half portion of said atomizing head and said driving mechanism, said casing having a second path for shaping air which is communicated with said first path.

2. An electrostatic coating apparatus in accordance with claim 1, wherein said coupling having a cylindrical skirt portion extending rearwardly, said skirt portion and an outer peripheral surface of said rear half portion of said atomizing head forming an annular recess opened rearwardly therebetween, at least a forward end portion of said casing surrounding said rear half portion of said atomizing head being cylindrical, said forward end portion being inserted into said annular recess so as to form a small clearance between an outer peripheral surface, an inner peripheral surface and an forward end surface of said cylindrical forward end portion, and the corresponding inner surfaces of said annular recess.

3. An electrostatic coating apparatus in accordance with claim 2, wherein said second path of said casing having a bent path portion at a transitional region between a first casing portion surrounding said driving mechanism and a second casing portion surrounding said rear half portion of said atomizing head, said bent path portion having an annular chamber extending in a circumferential direction, said second path forward of said annular chamber having a plurality of through holes equally spaced in a circumferential direction.

* * * * *